US011473754B1

(12) United States Patent
Wu

(10) Patent No.: US 11,473,754 B1
(45) Date of Patent: Oct. 18, 2022

(54) NIGHT LIGHT PROJECTOR

(71) Applicant: YOU GOT INVESTMENT DEVELOPMENT LIMITED LIABILITY COMPANY, Arcadia, CA (US)

(72) Inventor: Chao Wu, Arcadia, CA (US)

(73) Assignee: YOU GOT INVESTMENT DEVELOPMENT LIMITED LIABILILTY, Arcadia, CA (US)

( * ) Notice: Subject to any disclaimer, the term of this patent is extended or adjusted under 35 U.S.C. 154(b) by 0 days.

(21) Appl. No.: 17/503,048

(22) Filed: Oct. 15, 2021

(51) Int. Cl.

| | |
|---|---|
| ***F21V 3/06*** | (2018.01) |
| ***F21V 3/02*** | (2006.01) |
| ***F21V 23/04*** | (2006.01) |
| ***F21V 17/02*** | (2006.01) |
| *F21Y 115/10* | (2016.01) |
| *F21Y 113/17* | (2016.01) |

(52) U.S. Cl.
CPC ..... *F21V 3/062* (2018.02); *F21V 3/02* (2013.01); *F21V 17/02* (2013.01); *F21V 23/0485* (2013.01); *F21Y 2113/17* (2016.08); *F21Y 2115/10* (2016.08)

(58) Field of Classification Search
CPC . F21V 3/062; F21V 3/02; F21V 17/02; F21V 23/0485; F21Y 2113/17; F21Y 2115/10
USPC ..... 362/363
See application file for complete search history.

(56) References Cited

U.S. PATENT DOCUMENTS 10,716,192 B1 * 7/2020 Tsibulevskiy ..... H02J 7/342

* cited by examiner

*Primary Examiner* — Rajarshi Chakraborty
*Assistant Examiner* — Hana S Featherly
(74) *Attorney, Agent, or Firm* — Calfee Halter & Griswold LLP

(57) ABSTRACT

A night light projector comprises a housing and a light emitter accommodated in the housing. The projector further comprises a rotator rotatable around the light emitter and a plastic film dome placed on the rotator and rotatable with the rotator. The plastic film dome covers the light emitter and allows partly transmitting and projecting the light from the light emitter. By means of the rotatable plastic film dome, the projector is able to project rotating spatial pattern into surrounding space.

13 Claims, 6 Drawing Sheets

NIGHT LIGHT PROJECTOR

TECHNICAL FIELD

The present application refers to a technical field of lighting appliance, and more particularly to the field of night light projector.

BACKGROUND

Colorful lighting is often used during the holidays or home parities, to decorate a house or yard. Especially, during night, a projector is frequently used for enhancing cheerful atmosphere.

SUMMARY

This application provides a kind of night light projector, which is able to produce various imaging on the wall or ceiling of the room.

In an aspect of the application, a night light projector is proposed, which comprising a housing and a light emitter accommodated in the housing, wherein the projector further comprises a rotator rotatable around the light emitter and a plastic film dome placed on the rotator and rotatable with the rotator, and the plastic film dome covers the light emitter and allows partly transmitting and projecting the light from the light emitter. By means of the rotatable plastic film dome, the projector is able to project rotating spatial pattern into surrounding space.

In some embodiments, the plastic film dome is made by material comprising PET or PVC and is partly coated with photosensitive ink so as to form multiple graphic patterns on the surface. The light from the light emitter is regulated by the graphic patterns and then is able to form on the surrounding wall or ceiling images with the patterns.

In some embodiments, the material of the plastic film dome has a transparency of above 85%. Higher transparency will increase the efficiency of the projector.

In some embodiments, the rotator comprises a support bracket and a gear ring fixed with each other, and the periphery of the support bracket is provided with a groove for supporting the plastic film dome, and the gear ring is driven by a motor mounted in the housing so as to indirectly drive the plastic film dome on the support bracket to rotate. By means of these, the revolving of the dome around the light emitter is realized.

In some embodiments, an output axis of the motor is connected to the gear ring via a gear set so as to reduce the revolving speed of the rotator. Too high a revolving speed would result in dizziness of user, so that a retarding mechanism is adapted in the projector. The revolving speed of the rotator may be reduced to a speed from 0.5 to 2 RPM. In some embodiments, the revolving speed of the rotator is reduced to 0.5 RPM. In other embodiments, the revolving speed of the rotator is reduced to 2 RPM.

In some embodiments, the plastic film dome has a hemisphere shape with a radius between 50 mm and 60 mm.

In some embodiments, the projector further comprises a base assembled in the housing for accommodating the rotator, and the periphery of the base has a downward flange being able to join with an upward opening of the housing.

In some embodiments, the projector further comprises an outer lampshade with a hemisphere shape for covering the plastic film dome, and the outer lampshade has a radius between 60 mm and 65 mm.

In some embodiments, the base has an upward flange being able to join with an opening of the outer lampshade, and the base, the outer lampshade and the housing, when joined together, have an appearance of quasi-sphere.

In some embodiments, the light emitter comprises four LED chips including a Red LED, a Green LED, a Blue LED and a White LED, and the LED chips are under individual control mode. By means of this, the light emitter will possess various emitting modes which increase playability of the projector.

In some embodiments, the four LED chips are arranged in a matrix on the light emitter, and a spacing between two adjacent LED chips has a proportion of ⅖ to ⅗ with respect to the radius of the dome. By means of this, the patterns of the dome will be suitably projected outside and double image will not be generated.

In some embodiments, the base is provided with several legs extending downward, the legs being fixed with the bottom of the housing. This contributes to the stability of the projector during revolving of the rotator.

In some embodiments, the projector further comprises a foundation support for supporting the housing, and the support is provided with a switch.

In some embodiments, the switch comprises a touch sensitive button provided on the foundation support, a conducting plate attached to the button and a deformed spring for electronically connecting the conducting plate to a switch control circuit in the foundation support. Such switch will have more reliability, life expectancy and lower power consumption.

The projector proposed by this application is able to produce dynamic image on the wall or ceiling during indoor usage. By suitably adjusting the dimension of the light emitter and the dome, the projector may have better projection effect and clearer image projected.

BRIEF DESCRIPTION OF DRAWINGS

Exemplifying embodiments of the application will be described below with reference to the accompanying drawings.

Figure 1:
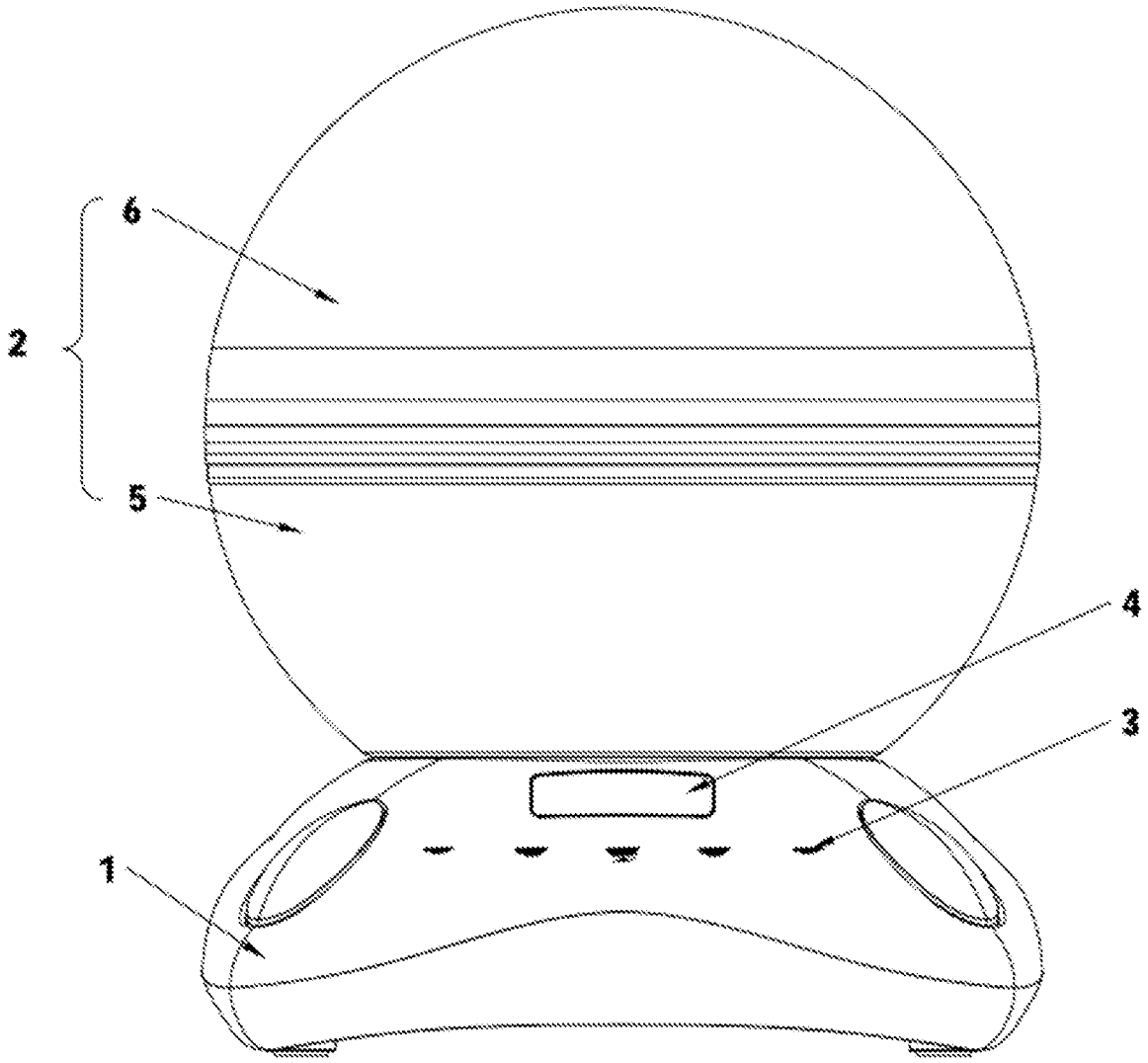
FIG. 1 illustrates an overall view of a night light projector according to an embodiment of the application.

All the figures are schematic, not necessarily to scale, and generally only show parts which are necessary in order to elucidate embodiments of the present application, wherein other parts may be omitted or merely suggested.

DETAILED DESCRIPTION

The present application will now be described hereinafter with reference to the accompanying drawings, in which exemplifying embodiments of the present application are shown. The present application may, however, be embodied in many different forms and should not be construed as limited to the embodiments of the present application set forth herein; rather, these embodiments of the present application are provided by way of example so that this disclosure will convey the scope of the application to those skilled in the art. In the drawings, identical reference numerals denote the same or similar components having a same or similar function, unless specifically stated otherwise.

FIG. 1 illustrates an example overall view of a night light projector according to an embodiment of the application. From FIG. 1, it can be seen that, the projector comprises a foundation support 1 and a quasi-spherical lighting main body 2 amounted on the foundation support 1. Specifically, several touch-sensitive buttons 3 and a display screen 4 are arranged on the support 1, which are used for interacting with user. The touch-sensitive buttons 3 may function as switches. It can be understood that, the number of the buttons (is five as shown in FIG. 1) is exemplary and can vary according to actual demand or the functions of the projector. The main body 2 comprises a housing 5 and an outer lampshade 6 which are assembled together to from a quasi-sphere. It should be noted that, the outer lampshade 6 can be taken away or remain on the housing during functioning of the projector. The lighting main body 2 at least has a light emitter which will be described in detail below. When the outer lampshade 6 is maintained on the housing 5, the light output from the main body 2 can be projected on the lampshade 6 so as to form colorful images on the lampshade 6. After the outer lampshade 6 is taken away, the output light will be projected into the environment around, and for example, can form various images on the wall or ceiling.

Figure 2:
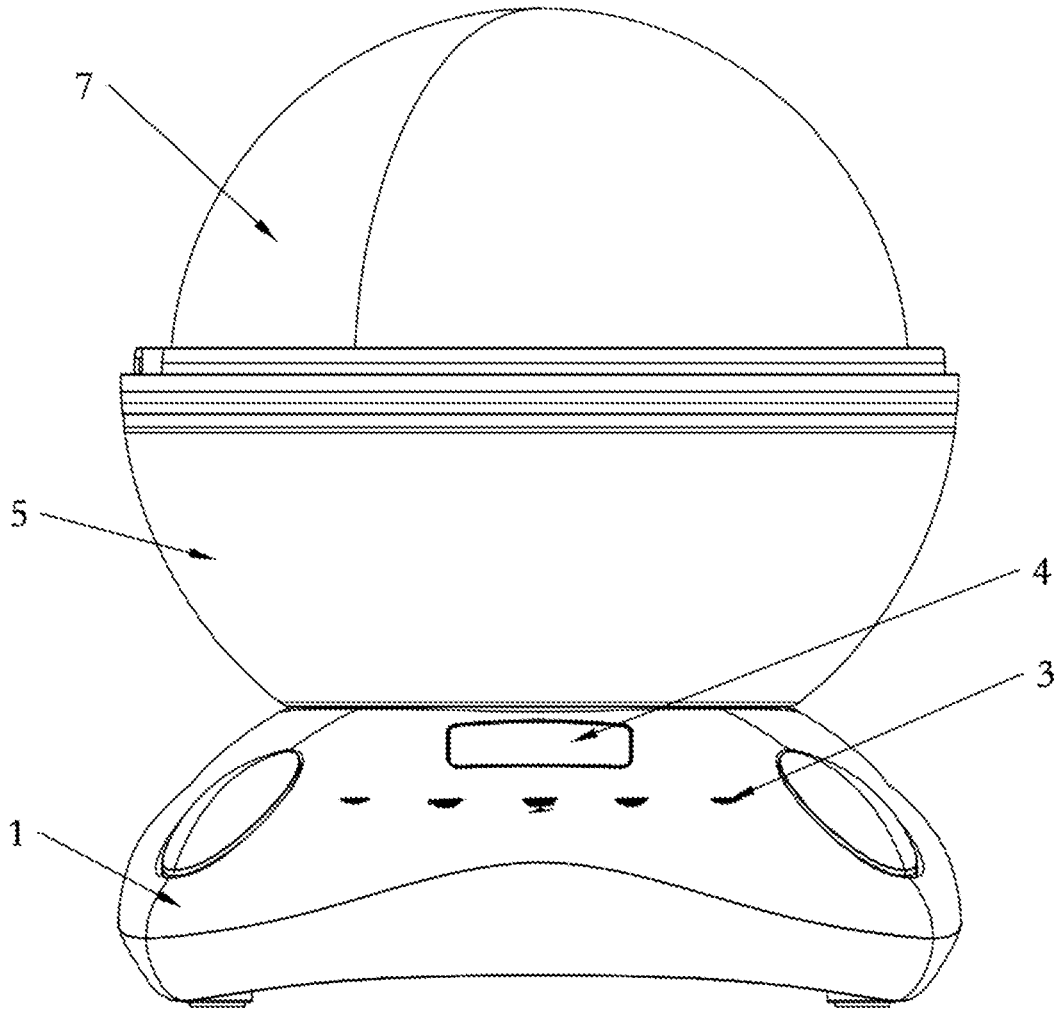
FIG. 2 illustrates anther overall view of the night light projector without outer lampshade.

FIG. 2 illustrates anther overall view of the night light projector without outer lampshade. From FIG. 2, it can be seen that a plastic film dome 7 is placed on the housing 5, and has a hemisphere shape. The plastic film dome 7 can be made by material such as PET or PVC, etc. In some embodiments, the material may have a transparency above 85%, that makes the dome 7 transmit more light from the main body. The dome 7 may be coated with photosensitive ink so as to form multiple graphic patterns. In an example, the portions of the dome 7 corresponding to the graphic patterns are free of ink while the other portion thereof is coated with ink, so that the portions corresponding to the graphic patterns allow light passing through which contributes to the function of projecting. The graphic patterns may have any shapes including but not being limited to the shapes of various animals, the moon, the sun, and trees, etc. After lighting function of the projector is turned on, the light passing through the patterns will form light spots with the features of the patterns irradiated on the lampshade or the wall around. It can be further seen that, a base 8 is shown on the housing 5, and is joined with the housing 5 at the periphery, so that the periphery surface of the base 8 is flush with the outer surface of the housing 5. A rotator 9 is also shown in the base 8, and is suitable for supporting the dome 7. After the revolving function of the projector is turned on, the rotator 9 will revolve in the base 8 and drive the dome 7 on it to revolve.

Figure 3:
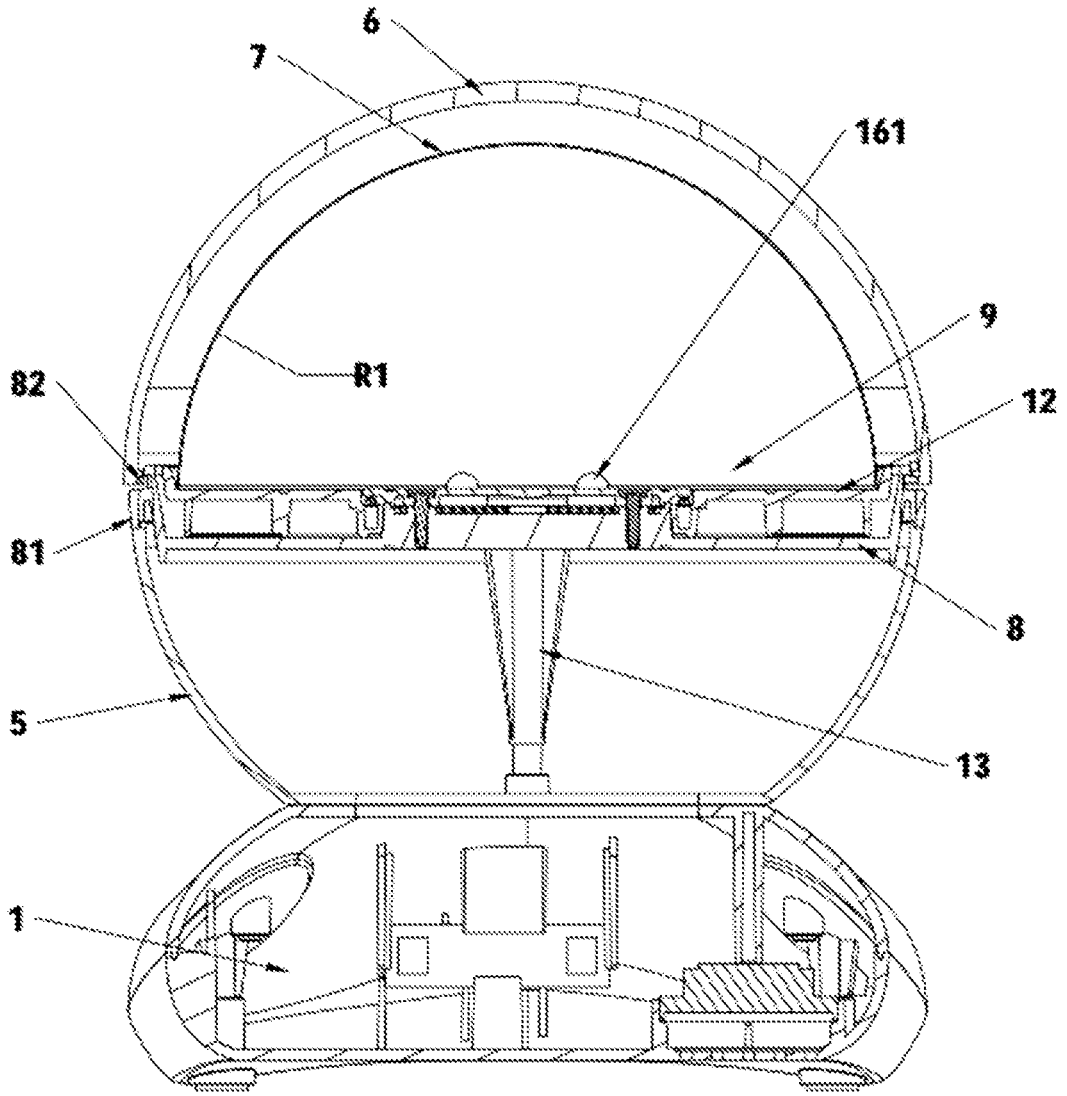
FIG. 3 illustrates a sectional view of a night light projector according to an embodiment of the application.
Figure 4:
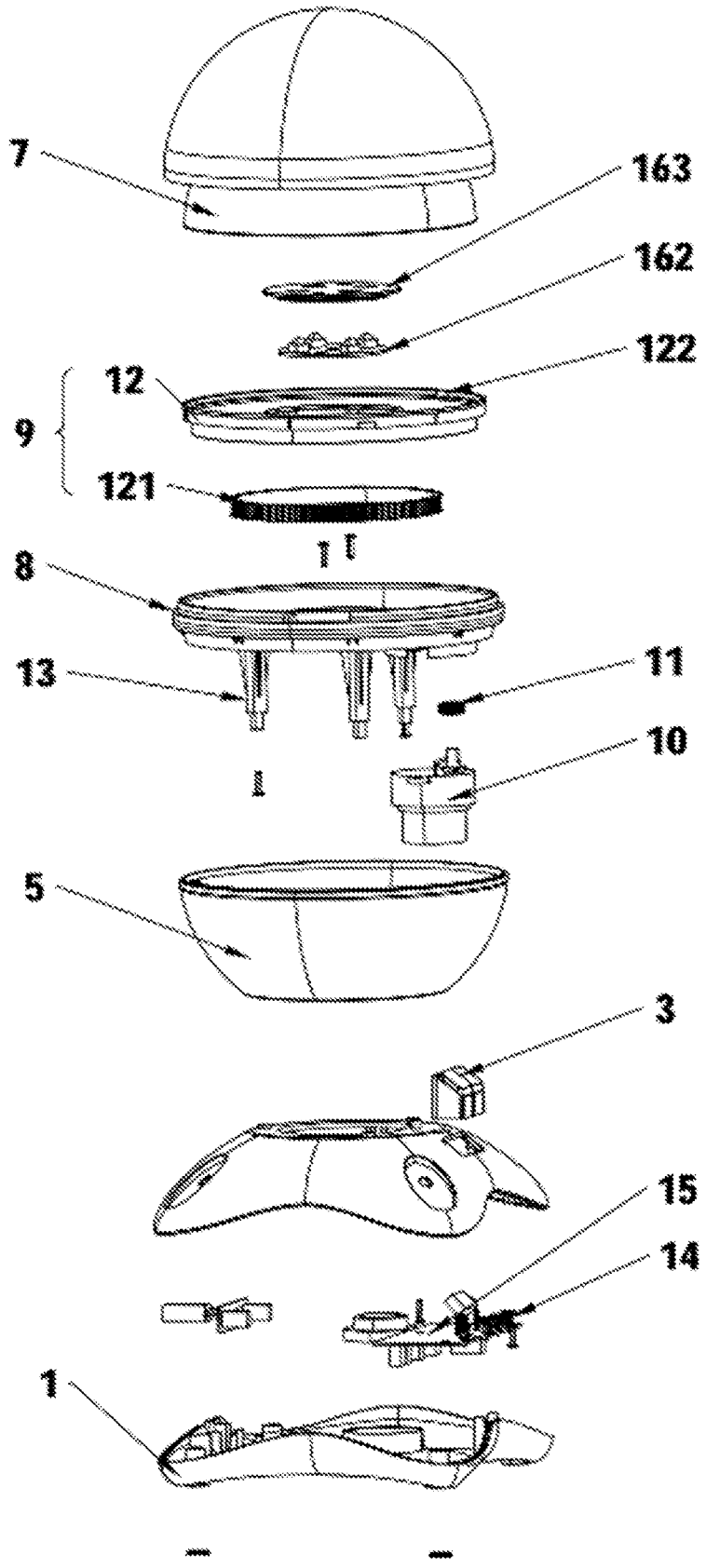
FIG. 4 illustrates an explosive view of a night light projector according to an embodiment of the application.

FIG. 3 illustrates a sectional view of a night light projector according to an embodiment of the application, while FIG. 4 illustrates an explosive view of the night light projector. The whole rotation mechanism of the projector will be described below with reference to FIGS. 3 and 4. The whole rotation mechanism may comprise a rotator 9 as mentioned above, a motor 10 and at least one gear 11. The rotator 9 may have a support bracket 12 and a gear ring 121, which are fixed with each other. Specifically, the support bracket 12 may have an overall shape of disk, and an edge thereof has an extension extending upwardly, so as to form a circular groove for accommodating the edge of the dome 7. Preferably, several bayonets 122 are distributed at the groove for facilitating holding the edge of the dome 7. Apparently, the dome 7 is replaceable from the housing 5, and therefore the user can select one from several kinds of plastic film domes with different pattern themes. The gear ring 121 may be attached under the bottom surface of the support bracket 12, and more particularly be fixed at an annular rib formed under the bottom surface thereof. Meanwhile an output axis of the motor 10 is connected to the gear ring 121 via at least one gear 11. Based on that, the combination of the gear ring 121 and gear 11 forms a retarding mechanism which can realize slow revolution of the dome 7. In an example, the revolving speed of the dome is 2 rpm. It should be understood that there may be more than one gear 11 (forming a gear set) for transmission between the motor 10 and the gear ring 121. In FIG. 4, the motor 10 is shown as being fixed under the bottom surface of the base, and it should be understood that the motor 10 can be fixed at other positions as needed.

As shown in FIG. 4, there are several legs 13 extending downward from the base 8, where the legs are fixed with the bottom of the housing 5 and function as the supporter of the base. In another embodiment, the legs 13 are fixed with the foundation support 1 through the housing 5. In an optional example, the legs are fixed by screws.

Also as shown in FIG. 4, the foundation support 1 may be provided with several switches. One of the switches comprises a touch sensitive button 3 provided on the foundation support 1, a conducting plate (no shown) attached to the button and a deformed spring 14 for electronically connecting the conducting plate to a switch control circuit 15 in the foundation support 1. In an optional example, there is a speaker provided in the projector. The speaker may be installed in the foundation support 1 and be under control of the switches.

Figure 5:
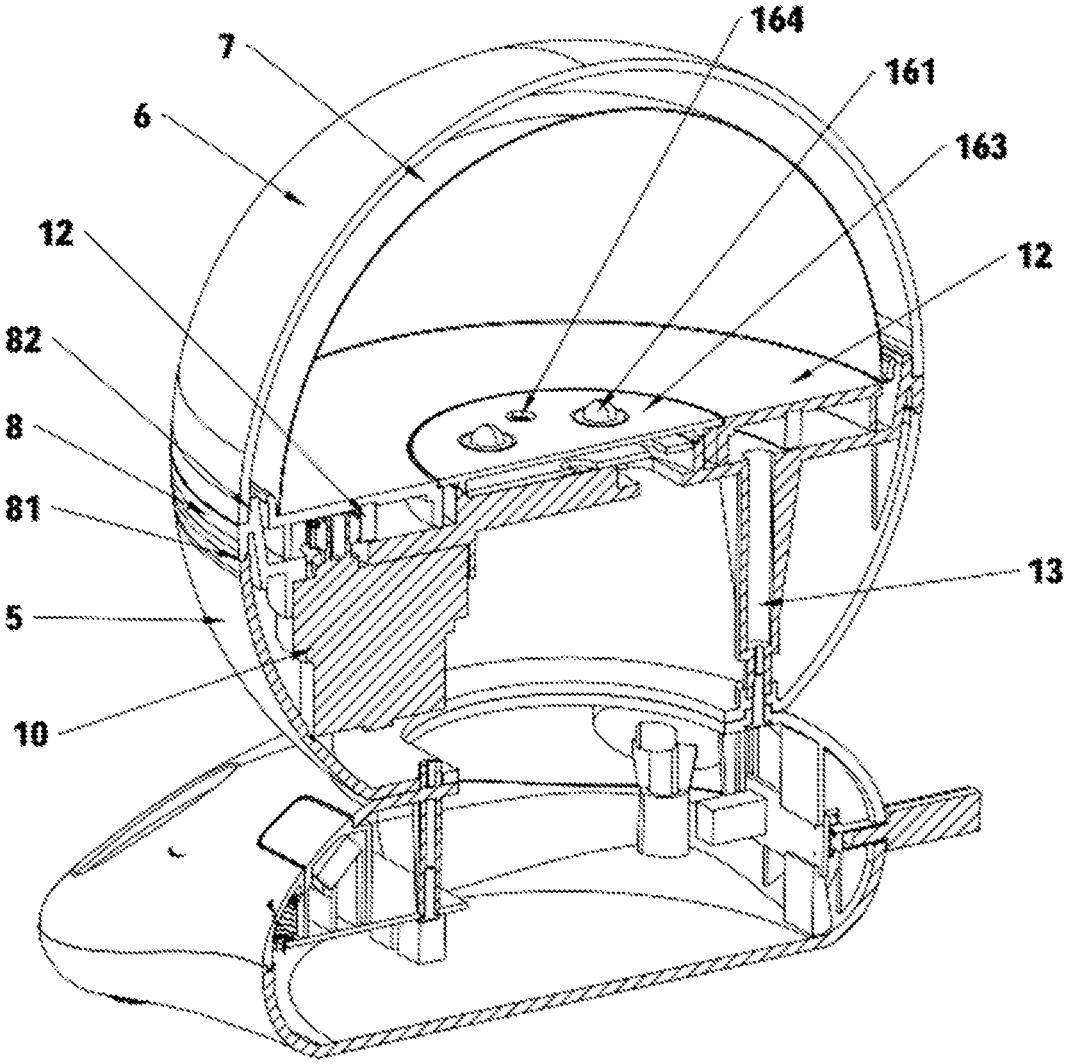
FIG. 5 illustrates another sectional view of a night light projector according to an embodiment of the application.

FIG. 5 illustrates another sectional view of a night light projector according to an embodiment of the application. From FIG. 5, it can be seen that the outer surfaces of the base 8, the outer lampshade 6 and the housing 5, when joined together, have an appearance of quasi-sphere, so as to increase aesthetic of the projector and protective performance for built-in components. In an optional example, the periphery of the base 8 may have a downward flange 81 being able to join with an upward opening of the housing 5, so as to prevent inside light from leaking from the joint between the base 8 and the housing 5. Besides, the base 8 may have an upward flange 82 being able to join with an opening of the outer lampshade 6, and the base, the outer lampshade and the housing, when joined together, may have an appearance of quasi-sphere.

Figure 6:
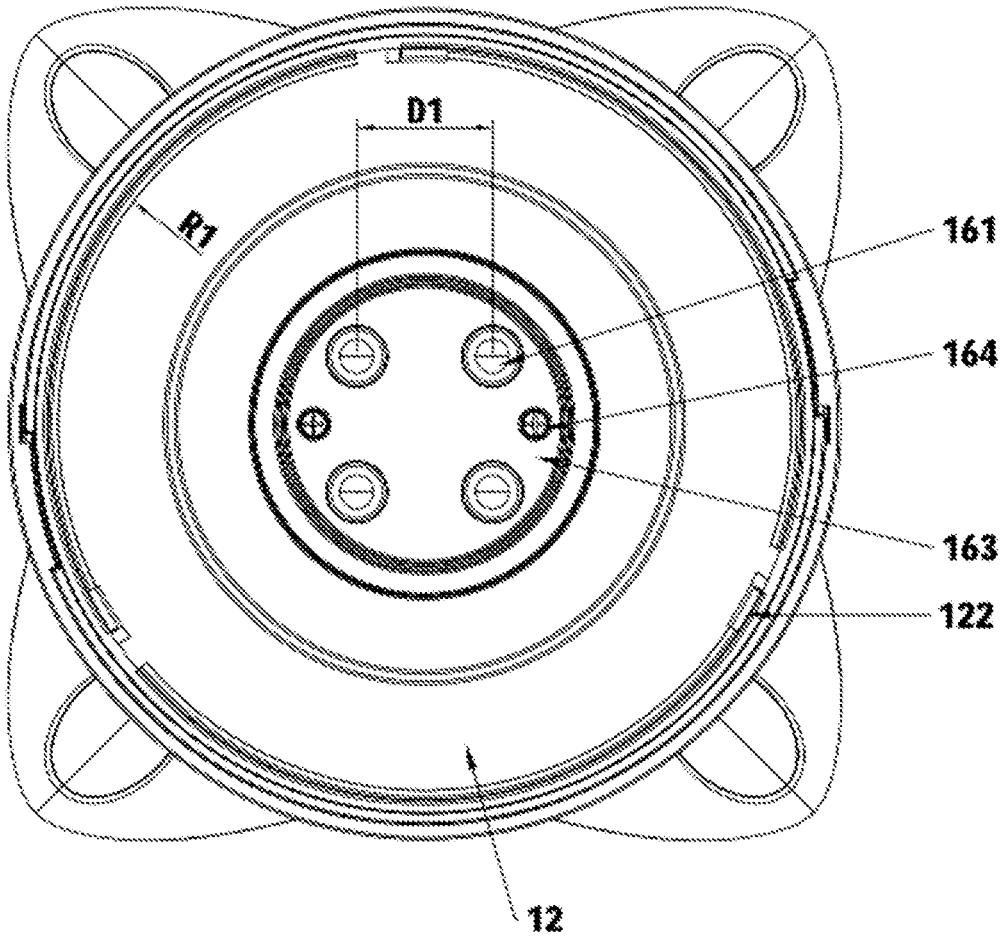
FIG. 6 illustrates a top view of the night light projector showing the structure of the light emitter.

FIG. 6 illustrates a top view of the night light projector showing the structure of the light emitter. Referring to FIGS. 5 and 6, the construction of the projector about the light emitter in the lighting main body 2 will be described below. As shown, the light emitter 16 is mounted in the center of the rotator 9. In an optional example, the support bracket 12 of the rotator 9 has a center opening, which allows the light emitter 16 being fixed with the base 8 below the rotator. Therefore, while the rotator 9 rotates, the light emitter 16 stands still, so that the dome 7 above the rotator 9 rotates around the light emitter 16.

The light emitter 16 for example comprises four LED chips 161 including a Red LED, a Green LED, a Blue LED and a White LED, and the LED chips are under individual control mode. In some embodiments, the four LED chips are arranged in a matrix on the light emitter. It should be noted that, the spacing D1 between two adjacent LED chips is in proportion to the dimension of the dome 7. For example, the proportion of the above spacing D1 and the radius R1 of the dome is between ⅕ and ⅗, and preferably is ⅖. In an optional embodiment, the spacing D1 is between 18 mm and 22 mm, while the radius of the dome 7 is between 50 mm and 60 mm. Accordingly, in the optional embodiment, the outer lampshade has a radius between 60 mm and 65 mm.

As shown in FIGS. 3 and 5, the light emitter 16 further comprises a substrate 162 for supporting the LED chips and a cover plate 163 placed on the substrate 162. It can be seen that a surface of the cover plate 163 is flush with the surface of the support bracket 12, and there are four holes in the cover plate 163 for facilitating protruding of the LED chips. This contributes to aesthetics and the well-functioning of the light emitter 16. In an example, the cover plate 163 is fixed with the base via one or more screws 164.

While the present application has been illustrated in the appended drawings and the foregoing description, such illustration is to be considered illustrative or exemplifying and not restrictive; the present application is not limited to the disclosed embodiments. Other variations to the disclosed embodiments can be understood and effected by those skilled in the art in practicing the claimed application, from a study of the drawings, the disclosure, and the appended claims. In the appended claims, the word "comprising" does not exclude other elements or steps, and the indefinite article "a" or "an" does not exclude a plurality. The mere fact that certain measures are recited in mutually different dependent claims does not indicate that a combination of these measures cannot be used to advantage. Any reference signs in the claims should not be construed as limiting the scope.

What is claimed is:

1. A night light projector, comprising:

a housing, a light emitter accommodated in the housing, a rotator rotatable around the light emitter, and a plastic film dome placed on the rotator and rotatable with the rotator, wherein the plastic film dome covers the light emitter and allows partial transmitting and projecting of the light from the light emitter, wherein the rotator comprises a support bracket and a gear ring fixed with each other, and the periphery of the support bracket is provided with a groove for supporting the plastic film dome, and the gear ring is driven by a motor mounted in the housing so as to indirectly drive the plastic film dome on the support bracket to rotate.

2. The night light projector according to claim 1, wherein the plastic film dome is made by material comprising PET or PVC and is partly coated with photosensitive ink so as to form multiple graphic patterns on the surface.

3. The night light projector according to claim 2, wherein the material of the plastic film dome has a transparency of above 85%.

4. The night light projector according to claim 1, wherein an output axis of the motor is connected to the gear ring via a gear set so as to reduce the revolving speed of the rotator to 2 RPM.

5. The night light projector according to claim 1, wherein the plastic film dome has a hemisphere shape with a radius between 50 mm and 60 mm.

6. The night light projector according to claim 1, wherein the night light projector further comprises a base assembled in the housing for accommodating the rotator, and the periphery of the base has a downward flange being able to join with an upward opening of the housing.

7. The night light projector according to claim 6, wherein the night light projector further comprises an outer lampshade with a hemisphere shape for covering the plastic film dome, and the outer lampshade has a radius between 60 mm and 65 mm.

8. The night light projector according to claim 7, wherein the base has an upward flange being able to join with an opening of the outer lampshade, and the base, the outer lampshade and the housing, when joined together, have an appearance of approximate sphere.

9. The night light projector according to claim 6, wherein the base is provided with several legs extending downward, wherein the legs are fixed with the bottom of the housing.

10. The night light projector according to claim 1, wherein the light emitter comprises four LED chips including a Red LED, a Green LED, a Blue LED and a White LED, and the LED chips are under individual control mode.

11. The night light projector according to claim 10, wherein the four LED chips are arranged in a matrix on the light emitter, and a spacing between two adjacent LED chips has a proportion of ⅖ to ⅗ with respect to the radius of the dome.

12. The night light projector according to claim 1, wherein the night light projector further comprises a foundation support for supporting the housing, wherein the support is provided with a switch.

13. The night light projector according to claim 12, wherein the switch comprises a touch sensitive button provided on the foundation support, a conducting plate attached to the button and a deformed spring for electronically connecting the conducting plate to a switch control circuit in the foundation support.

* * * * *